US006694597B2

(12) United States Patent
Wang et al.

(10) Patent No.: US 6,694,597 B2
(45) Date of Patent: Feb. 24, 2004

(54) METHOD FOR RIVETING METAL MEMBERS

(75) Inventors: Pei-Chung Wang, Troy, MI (US); Daniel B. Hayden, Macomb Township, MI (US); Paul M. Zardus, Royal Oak, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/094,128

(22) Filed: Mar. 8, 2002

(65) Prior Publication Data

US 2003/0167621 A1 Sep. 11, 2003

(51) Int. Cl.[7] ..... B21J 15/02
(52) U.S. Cl. ..... 29/525.06; 29/525.05
(58) Field of Search ..... 29/525.06, 525.05, 29/525.13, 525.14, 432; 219/157, 158

(56) References Cited

U.S. PATENT DOCUMENTS 5,752,305 A 5/1998 Cotterill et al.
5,957,777 A 9/1999 Singh et al.
6,405,420 B1 * 6/2002 Donhauser et al. ..... 29/432.2
6,417,490 B1 * 7/2002 Liebrecht et al. ..... 219/157

* cited by examiner

*Primary Examiner*—John C. Hong
(74) *Attorney, Agent, or Firm*—Kathryn A. Marra

(57) ABSTRACT

A method and apparatus for riveting metal members, and particularly, metal sheets is disclosed. The apparatus includes a rivet assembly for driving rivets into stacked metal sheets and a die assembly for assisting in supporting the sheets during driving of the rivets and for assisting in securing the rivets to the sheets. The rivet assembly, the die assembly or both in combination provide energy to at least a portion of the metal sheets prior to riveting. In turn, the energy elevates the temperature of the portion of the sheets such that the rivets can be more effectively driven into the sheets and such that the sheets are fastened to each other with greater ease and consistency.

15 Claims, 3 Drawing Sheets

METHOD FOR RIVETING METAL MEMBERS

CROSS REFERENCE TO RELATED APPLICATIONS

This invention is related to commonly assigned and co-pending U.S. Ser. No. 09/934,342.

TECHNICAL FIELD

The present invention relates to a method and apparatus for riveting metal members together for assembling automotive vehicle structures.

BACKGROUND OF THE INVENTION

It is known that the manufacture of automotive vehicles often requires that metal members be attached to each other to form automotive vehicle structures. Pierce riveting is one potential method of attaching such members, particularly, metal sheets. Pierce riveting typically requires a sharpened end portion of a rivet to pierce through a first of two stacked metal sheets, and through at least a portion of a second of the stacked sheets. During such piercing, the sharpened end portion of the rivet is typically deformed or bent to secure the rivet to the sheets. For conventional pierce riveting processes, however, large amounts of force may be required to pierce through the sheets. Moreover, for higher strength sheets, the rivets may deform prior to proper piercing of the sheets or the sheets may be undesirably cracked during the riveting process. Thus, there is a need for improved pierce riveting techniques, apparatuses or both, for achieving high integrity attachment of metal members, particularly, sheets formed of refractory or high strength to weight metals such as those based on aluminum, magnesium, iron, high strength steel or the like.

SUMMARY OF THE INVENTION

The present invention meets these needs by providing an improved method of riveting a first metal member to a second metal member, with particular utility in the formation of components for an automotive vehicle. The method involves providing a piercing rivet having a central axis, a generally disk-shaped head portion and an annular portion extending outwardly from a bottom surface of the head portion, the annular portion including a sharpened piercing edge. For riveting, a first metal member is stacked on a second metal member, wherein each of the members has a first side and a second side, and at least a portion of the second side of the first member is in overlapping contact with at least a portion of the first side of the second member for forming an overlapped region. The first and second metal members are placed between a rivet assembly and a die assembly, the rivet assembly including a punch surrounded by a first electrode for contacting the first member, the die assembly including a die surrounded by a second electrode for contacting the second member, the die having a cylindrical cavity with a protrusion extending into the cavity, the first and second electrodes each connected to an electrical energy source. Thereafter, an electrical current is induced with the electrical energy source, the current flowing between the first and second electrodes and through the first and second metal members for heating the overlapped region of the first member and the second member to a more ductile condition. The rivet is driven through the first metal member and partially through the second metal member in the overlapped region such that the annular portion of the rivet is deformed radially away from the central axis to interferingly secure the rivet to the members thereby attaching the members to each other.

The present invention also provides an apparatus for riveting a first metal sheet to a second metal sheet. The apparatus includes a rivet assembly for driving a rivet through the first metal sheet and partially through the second metal sheets while the first sheet is stacked upon the second sheet. The rivet assembly includes a cylindrical punch moveable between at least a first position and a second position for driving the rivet through the first sheet and partially through the second sheet. The rivet assembly also includes a generally cylindrical binder clamp that is cylindrical about a centrally located axis, the binder clamp having a cylindrical hole that is coaxial with the axis and extends down the center of the binder clamp for receiving the punch. A cylindrical first electrode surrounds at least a portion of the binder clamp, the first electrode for contacting and supplying electricity to the metal sheets to heat the sheets prior to driving the rivet into the sheets. An insulator is disposed between the first electrode and the binder clamp for electrically separating the first electrode from the binder clamp. The apparatus also includes a die assembly for at least partially supporting the first and second sheets as the rivet assembly drives the rivet into the sheets, the die assembly. The dies assembly includes a central cylindrical die having a central cylindrical cavity defined by a circular bottom surface and an annular surface, the circular bottom surface defining a centrally located protrusion extending into the cavity. The die assembly also includes a cup shaped second electrode for conducting electricity with the first electrode, the second electrode having a generally cylindrical cavity for receiving the die. A cup shaped insulator electrically separates the second electrode from the die, the insulator receiving the die in a cavity within the insulator, the insulator being receivable within the cavity of the electrode. The apparatus also include an energy source for inducing an electrical current across the electrodes.

The present invention thus provides an improved riveting apparatus and riveting technique for providing securing piercing rivets in stacked sheets thereby more securely fastening the sheets together. The ability to locally control the temperature of the members being joined makes this invention particularly advantageous for the joining of high strength to weight metals or materials with ordinarily low ductility.

BRIEF DESCRIPTION OF THE DRAWINGS

These and other aspects and advantages of the present invention will become apparent upon reading the following detailed description in combination with the accompanying drawings, in which.

DETAILED DESCRIPTION OF THE PREFERRED EMBODIMENT

Figure 1:
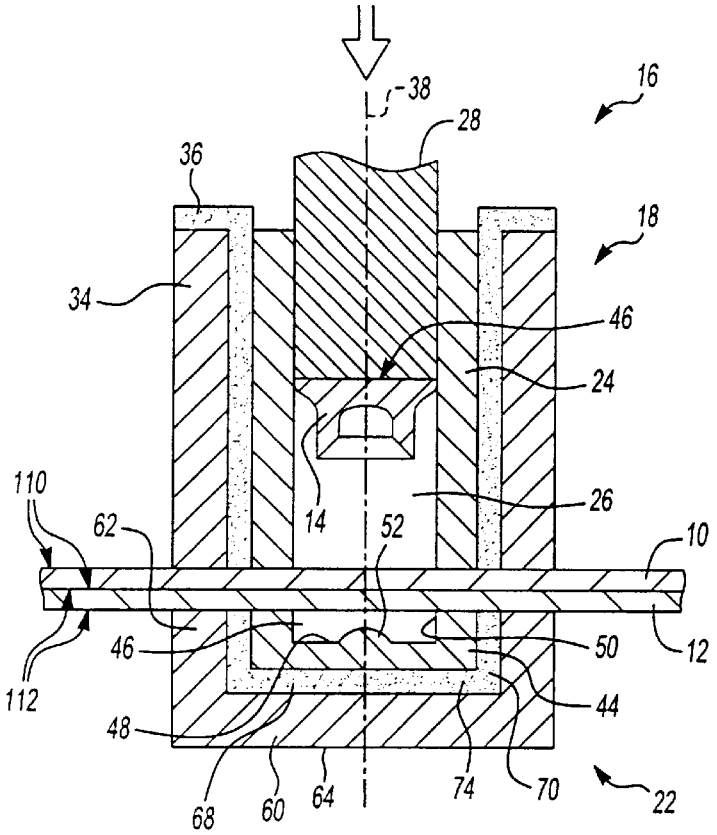
FIG. 1 is a sectional view of a riveting apparatus prior to riveting a pair of stacked metal sheets to each other.

Referring to FIGS. 1–4, a first metal member (depicted as a sheet 10) is riveted to a second metal member (depicted as a sheet 12) with a piercing rivet 14 that is driven into the sheets 10, 12 by a riveting apparatus 16. The riveting apparatus 16 includes a rivet driving assembly 18 for driving the rivet 14 through the first sheet 10 and into the second sheet 12 and a die assembly 22 for supporting the metal sheets 10, 12 and for assisting in securing the rivet 14 to the sheets 10, 12.

Figure 3:
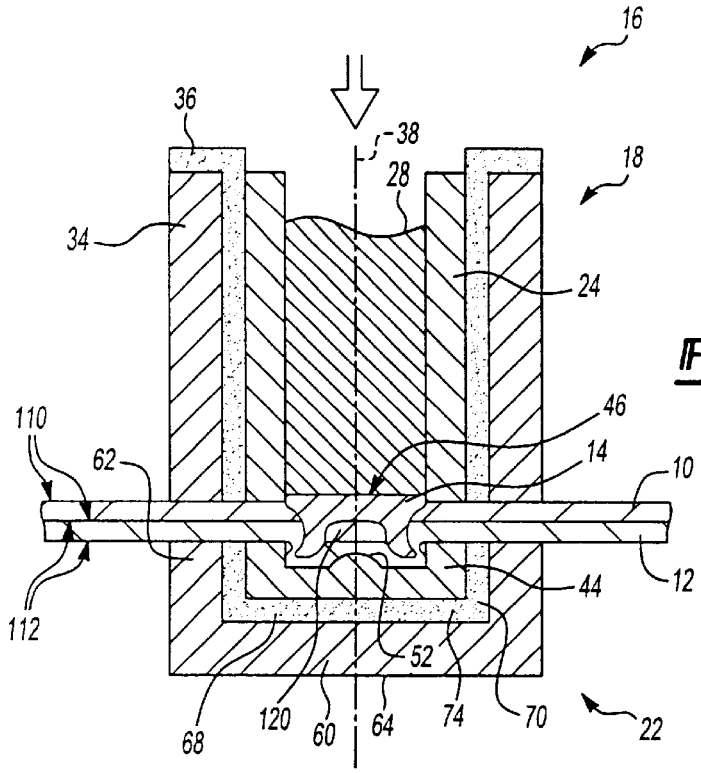
FIG. 3 is a sectional view of the riveting apparatus of FIG. 1 further along in the riveting of the pair of stacked metal sheets to each other.
Figure 4:
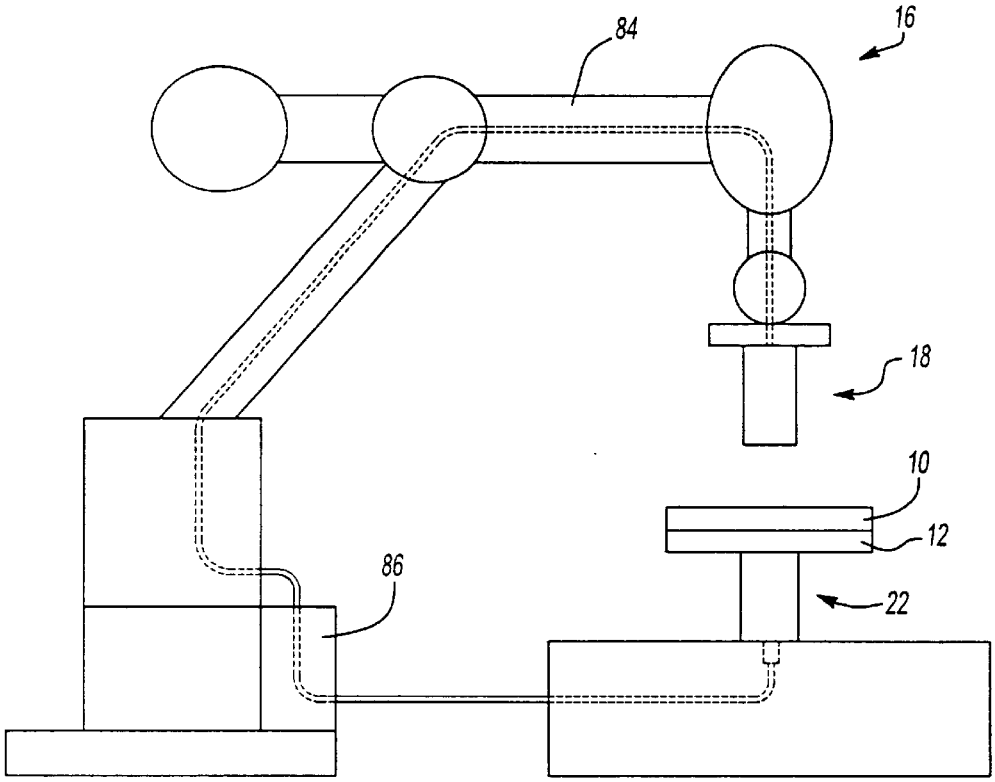
FIG. 4 illustrates the riveting apparatus of FIGS. 1, 2 and 3 with a robot arm and an energy source.

The rivet assembly 18 includes a clamp 24 (e.g., a generally elongated metal binder) having an opening 26 extending down a length of the binder clamp 24. A punch 28 (e.g., an elongated cylindrical steel punch) of the assembly 18 is received in the opening 26 and the punch 28 is moveable along a length of the opening 26 between at least a first position, as shown in FIG. 1, and a second position, as shown in FIG. 3. The punch 28 may be moved hydraulically, mechanically, electrically, pneumatically or otherwise.

An electrode 34 (e.g., a copper electrode) of the rivet assembly 18 is generally annular and surrounds at least a portion of the binder clamp 24 and the hole 26 through which the punch 28 moves. A generally annular insulator 36 of the rivet assembly 18 is disposed between the binder clamp 24 and the electrode 34 to electrically separate the electrode 34 from the binder clamp 24 and the punch 28. The insulator 36 may be formed of an insulative material such as a plastic, polymer, ceramic, or the like. In one preferred embodiment, the insulator 36 is a laminate formed with a fabric or paper molded with a synthetic resin.

Figure 2:
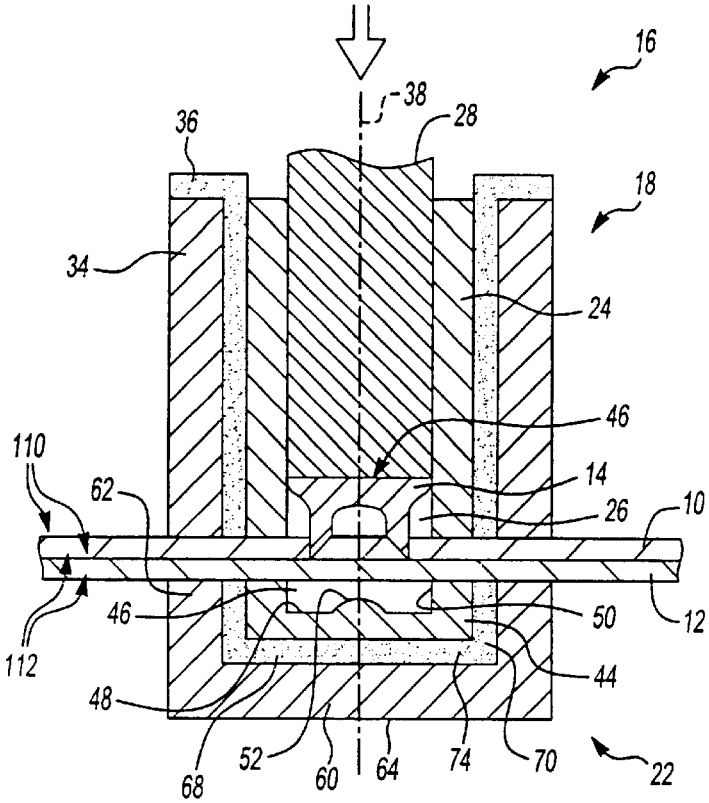
FIG. 2 is a sectional view of the riveting apparatus of FIG. 1 during riveting of the pair of stacked metal sheets to each other.

In FIGS. 1–3, the punch 28, the opening 26, the insulator 36 and the electrode 34 are generally cylindrical, coaxial or both about a central axis 38 extending centrally along their lengths. Preferably, a housing (not shown) can be used to fasten the electrode 34, the insulator 36, and the binder clamp 24 together. Alternatively, other conventional fasteners or fastening techniques may be used.

The die assembly 22 includes a generally cylindrical die 44 having a central cylindrical opening or cavity 46 defined by a bottom circular surface 48 and a peripheral annular wall surface 50, which may be integrated into a single continuous surface. Preferably, the die 44 includes a protrusion 52 that extends into the cavity from the center of the circular surface 48. Alternatively, the die 44 may be formed in a variety of sizes or with a variety of cavity shapes depending upon the rivet 14 to be driven into the sheets 10, 12, the properties of the sheets 10, 12, the thickness of the sheets or a combination thereof.

The die assembly 22 further includes a generally cup shaped electrode 60 with an annular portion 62 and a base portion 64 that cooperatively define a cavity for receiving the die 44. Preferably, the die assembly 22 also includes a generally cup-shaped insulator 68 with an annular portion 70 and a base portion 74 defining a cavity wherein the insulator 68 is formed of a material similar to the material of the insulator 36 of the rivet assembly 18. As shown, the insulator 68 fits within the cavity (preferably flush) of the electrode 60 and the die 44 is received in the cavity of the insulator 68 for electrically separating the die 44 from the electrode 60. By changing the dimensions of the insulator 68, the die 44 or both, a variety of different dies having a variety of different sized or shaped cavities may be interchanged within the cavity of the electrode 60 if desired. The components of the rivet assembly 18 and the die assembly 22 may be fastened together as desired by conventional fasteners, adhesives, a housing or the like.

The rivet assembly 18, the die assembly 22 or both may be mounted to various apparatus for moving the rivet assembly 18 or the die assembly 22 relative to each other, such as robots, C-frames and hard tooling such as a die set, or the like. In the exemplary embodiment shown in FIG. 4, the rivet assembly 18 is attached to a robot arm 84 that can move the rivet assembly 18 as desired. The die assembly 22 is stably positioned adjacent the robot arm 84.

An energy source 86 such as a transformer or other energy source is electrically coupled to the electrodes 34, 60 of the rivet assembly 18 and the die assembly 22 for providing electricity (e.g., current or voltage) to those electrodes 34, 60.

Figure 5A:
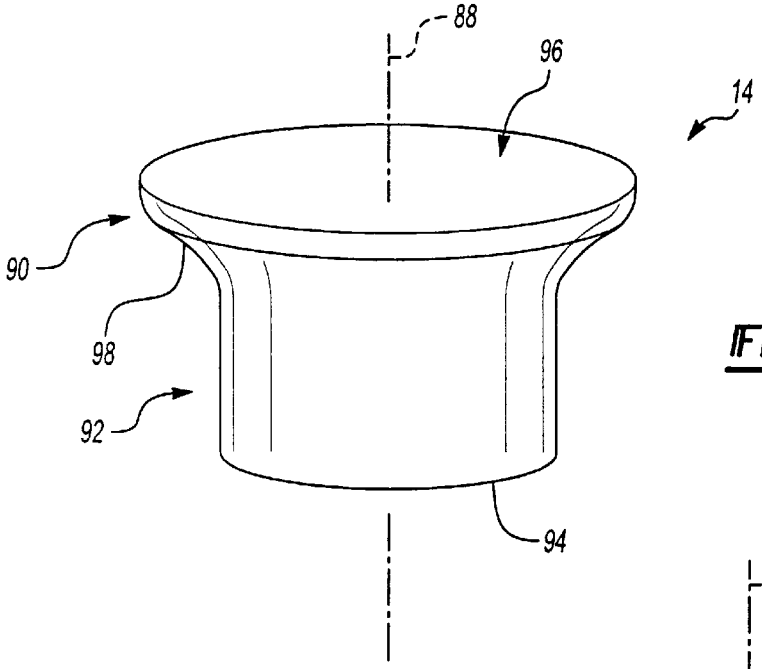
FIGS. 5(*a*) and 5(*b*) illustrate perspective views of a preferred rivet.
Figure 5B:
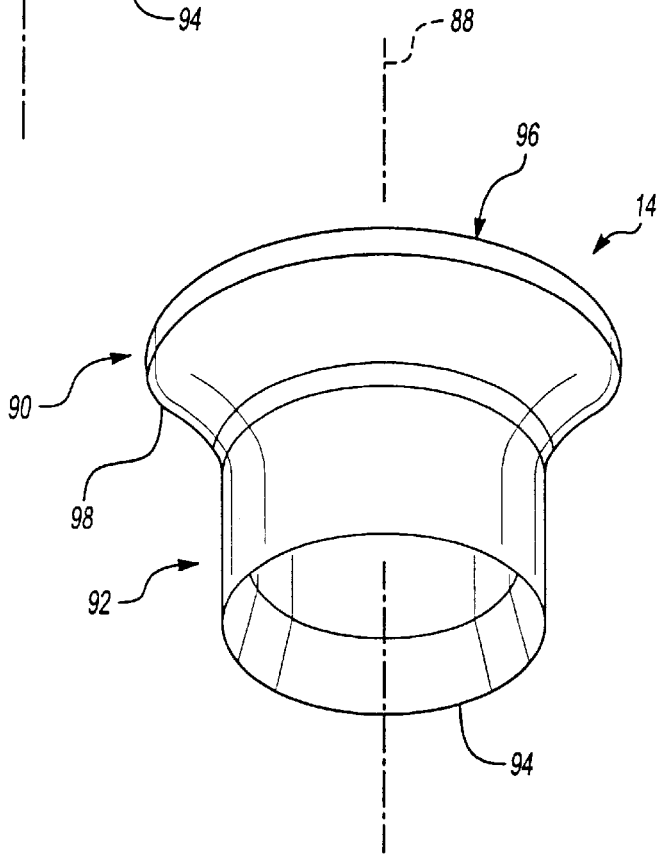

Now with reference to FIGS. 5(*a*) and 5(*b*), the piercing rivet 14 is substantially symmetrical about a central axis 88 and includes a head portion 90 and a body portion 92 with a sharpened edge portion 94, that is adapted to both pierce a material and deform during piercing for forming an interlock. As shown, in one example, the head portion 90 is generally disk-shaped with a substantially flat top surface 96 and a bottom surface 98. The body portion 92 is generally annular and extends outwardly away from the bottom surface 98 of the head portion 90. Preferably, the head portion 90 extends radially outwardly away from the central axis 88 further than the body portion 92.

The rivet 14 may be formed of a variety of high strength to weight metals such as aluminum or magnesium alloys. Preferably, however, the rivet 14 is formed of a refractory metal such as high strength steel. Optionally, the rivet 14 may be coated with a suitable protective coating, such as with an anti-corrosion agent, or may be selectively hardened at certain portion for achieving a hardness gradient in the rivet.

In alternative embodiments, various other piercing rivets may be used. As an example, a rivet having an adhesive may be used such as the rivets disclosed in commonly owned copending application titled "A Rivet and Method for Riveting Metal Sheets Therewith", U.S. Ser. No. 10/094,073 filed on the same date as the present application and fully incorporated herein by reference for all purposes.

Referring additionally to FIGS. 1–3, the piercing rivet 14 is positioned within the rivet assembly 18 for allowing the punch 28 to drive the rivet 14 into the sheets 10, 12. As shown, the top surface 96 of the rivet 14 is contacted substantially flush against the punch 28. The rivet 14 may be temporarily secured against the punch 28, such as by magnetic forces, with a securing member (not shown), or otherwise.

The first metal sheet 10 and second metal sheet 12 each include a first side 110 and a second side 112. The first sheet 10 is stacked upon the second sheet 12 such that at least a portion of the second side 112 of the first sheet 10 is in substantially continuous contact with at least a portion of the first side 110 of the second sheet 12 to form an overlapping portion or region for receiving the rivet 12. The sheets 10, 12 may be formed of several metals. Preferably, the sheets 10, 12 are formed of a high strength or refractory metal such as an aluminum alloy, a magnesium alloy, a high strength steel or the like with thicknesses ranging between 0.6 mm and 3.0 mm, although thicker of thinner sheets may also be used.

The stacked sheets 10, 12 are placed between the rivet assembly 18 and the die assembly 22 of the riveting apparatus 16. Preferably, the sheets 10, 12 are placed upon the die assembly 22 such that the second side 112 of the second sheet 12 contacts the die assembly 22. Thereafter, the rivet assembly 18 is contacted with first side 110 of the first sheet 10 (e.g., using the robot arm 84 or another apparatus) to clamp the sheets 10, 12 between the rivet assembly 18 and the die assembly 22.

When the sheets 10, 12 are clamped between the assemblies 18, 22, the electrode 34 of the rivet assembly 18 is in contact with the first side 110 of the first sheet 10 and the electrode 60 of the die assembly 22 is in contact with the second side 112 of the second sheet 12. The energy source 86 induces an electric current that flows between the two electrodes 34, 60 through each of the sheets 10, 12. Advantageously, the current may be applied for as short as about 1/30 of a second using about 20 kiloamps of electricity for aluminum, however, different levels of energy may be used for different amounts of time depending on the application. The current provides energy to the sheets 10, 12 thereby elevating the temperature of (i.e., resistive heating) at least a portion of each of the sheets 10, 12 (i.e., the overlapped region) to a desired temperature. Preferably, the heated portion is the overlapping region of the sheets 10, 12 in which the rivet 14 is to be driven.

Thereafter, the punch 28 is moved from its first position shown in FIG. 1 to its second position as shown in FIG. 3 to drive the rivet 14 at least partially through the overlapping region of the sheets 10, 12. As shown, the sharpened piercing edge 94 of the rivet 14 pierces entirely through the first sheet 10 and partially through the second sheet 12.

During driving of the rivet 14, the rivet 14 urges a portion 120 of the first and second sheets 10, 12 into contact with the protrusion 52 of the die 44 thereby pinching the portion 120 between the rivet 14 and the protrusion 52. In turn, the protrusion 52 places a force on the portion 120 of the sheets 10, 12 and the force is transmitted to the annular portion 92 of the rivet 14. This force at least partially bends or deforms the annular portion 92, starting with the sharpened edge 94, radially away from the central axis 88 of rivet 14 to interferingly secure the rivet 14 to the sheets 10, 12 thereby attaching the sheets 10, 12 to each other. Preferably, the rivet 14 is driven through the first sheet 10 and into the second sheet 12 until the top surface 96 of the head portion 90 is substantially flush with the first surface 110 of the first sheet 10.

Advantageously, heating of the sheets 10, 12 increases the ductility of the overlapping portion of the sheets 10, 12. Thus, the rivet 14 can be driven through the first sheet 10, and partially through the second sheet 12 relatively easily and preferably without any undesired deformation of the rivet 14 or undesired cracking of the sheets 10, 12. In preferred embodiments, the ductility of the overlapping region can be doubled, tripled or even quintupled.

Although, the assemblies shown use electrodes coupled to an electrical energy source, it is contemplated that other energy sources suitable for locally heating the sheets, such as lasers (e.g., carbon dioxide or Nd:Yag lasers) may be attached to or form part of the rivet assembly 18, the die assembly 22 or both. It is further contemplated that the electrodes 34, 60 may not surround the punch 28 or die 44, but may be otherwise associated with or adjacent the punch 28 or die 44 or that the electrodes 34, 60 may be integrally formed as the punch 28 or die 44.

The method and apparatus described above may be used for attaching several different automotive components that have sheet metal or sheet metal portions. Examples include peel joints, lap joints, various vehicle panels such as door panels, decklids, hoods, sunroof applications or the like. Furthermore, the overlapped regions of the sheets may be continuously bonded or intermittently bonded over some or all of its area.

Advantageously, riveting according to the present invention is inexpensive, can improve the consistency of rivet formation, and can extend the life of tooling used to drive and deform the rivets.

It should be understood that the invention is not limited to the exact embodiment or construction which has been illustrated and described but that various changes may be made without departing from the spirit and the scope of the invention.

What is claimed is:

1. A method of riveting a first member to a second member, comprising the steps of:

(a) providing a piercing rivet having a central axis, a generally disk-shaped head portion and an annular portion extending outwardly from a bottom surface of the head portion, the annular portion including a sharpened piercing edge;

(b) placing the first member on the second member, wherein each of the members has a first side and a second side, and at least a portion of the second side of the first member is in overlapping contact with at least a portion of the first side of the second member for forming an overlapped region;

(c) placing the first and second members between a rivet assembly and a die assembly, the rivet assembly including a punch surrounded by a first electrode for contacting the first member, the die assembly including a die surrounded by a second electrode for contacting the second member, the die having a cylindrical cavity with a protrusion extending into the cavity, the first and second electrodes each connected to an electrical energy source wherein at least one of said rivet assembly and said die assembly is electrically separated from the respective electrode;

(d) inducing an electrical current with the electrical energy source, the current flowing between the first and second electrodes and through the first and second members for heating the overlapped region of the first member and the second member to a more ductile condition; and (e) driving the rivet through the first member and at least partially through the second member in the overlapped region such that the annular portion of the rivet is deformed radially away from the central axis to interferingly secure the rivet to the members thereby attaching the members to each other.

2. A method as in claim 1, wherein the rivet is formed of a high strength steel.

3. A method as in claim 1, wherein the punch is electrically actuated for driving the rivet through the members.

4. A method as in claim 1, wherein the rivet assembly includes an insulator electrically separating the punch of the rivet assembly from the first electrode.

5. A method as in claim 1 wherein the die assembly includes an insulator electrically separating the die of the die assembly from the second electrode.

6. A method as in claim 1 wherein the first and second members are formed of metal.

7. A method as in claim 6 wherein the first and second members are formed of refractory metals.

8. A method as in claim 7 wherein the first and second members are formed of refractory metals chosen from the group consisting of an alloy of iron, aluminum and magnesium.

9. A method of riveting a first member to a second member, comprising the steps of:

(a) providing a piercing rivet having a central axis, a generally disk-shaped head portion and an annular portion extending outwardly from a bottom surface of the head portion wherein;

i) the head portion extends radially outwardly away from the central axis further the annular portion; and ii) the annular portion includes a free sharpened piercing edge;

(b) stacking a first member on a second member, wherein each of the members has a first side and a second side, and at least a portion of the second side of the first member is in overlapping contact with at least a portion of the first side of the second member for forming an overlapped region;

(c) placing the first and second members between a rivet assembly and a die assembly, the rivet assembly including a rivet punch surrounded by a first electrode for contacting the first member, the die assembly including a die surrounded by a second electrode for contacting the second member, the die having a cylindrical cavity with a protrusion extending into the cavity, the first and second electrodes each connected to an electrical energy source wherein at least one of said rivet assembly and said die assembly is electrically separated from the respective electrode;

(d) contacting the first electrode with the first side of the first member;

(e) contacting the second electrode with the second side of the second member;

(f) inducing an electrical current with the electrical energy source, the current flowing between the first and second electrodes and through the first and second members for heating the overlapped region of the first member and the second member to a more ductile condition; and (g) driving the rivet through the first member and at least partially through the second member in the overlapped region wherein;

i) the sharpened piercing edge pierces through the overlapped region of the first and second members;

ii) the annular portion of the rivet is deformed radially away from the central axis of rivet to interferingly secure the rivet to the members thereby attaching the members to each other; and iii) a top surface of the head portion is substantially flush with the first surface of the first member.

10. A method as in claim 9 wherein the rivet is formed of a high strength steel.

11. A method as in claim 9 wherein the punch is electrically actuated for driving the rivet through the members.

12. A method as in claim 9 wherein the rivet assembly includes an insulator electrically separating the punch of the rivet assembly from the first electrode.

13. A method as in claim 9 wherein the die assembly includes an insulator electrically separating the die of the die assembly from the second electrode.

14. A method as in claim 9 wherein the first and second members are formed of refractory metals.

15. A method as in claim 14 wherein the first and second members are formed of metals chosen from the group consisting of alloys of iron, aluminum and magnesium.

* * * * *